United States Patent [19]

Hayashi et al.

[11] 4,023,899

[45] May 17, 1977

[54] EXCESS DEVELOPING LIQUID REMOVING DEVICE FOR ELECTROPHOTOGRAPHY

[75] Inventors: Toshio Hayashi; Osamu Haruyama, both of Tokyo, Japan

[73] Assignee: Ricoh Co., Ltd., Tokyo, Japan

[22] Filed: June 25, 1975

[21] Appl. No.: 590,244

[30] Foreign Application Priority Data

June 29, 1974 Japan ..... 49-77026[U]

[52] U.S. Cl. ..... 355/10; 118/DIG. 23; 427/15

[51] Int. Cl.[2] ..... G03G 15/10

[58] Field of Search ..... 355/10, 15; 118/DIG. 23; 427/17, 15; 96/1 LY; 354/318

[56] References Cited

UNITED STATES PATENTS

| | | | |
|---|---|---|---|
| 3,752,119 | 8/1973 | Matkan | 118/DIG. 23 |
| 3,815,989 | 6/1974 | Davis et al. | 355/10 |
| 3,849,171 | 11/1974 | Takahashi et al. | 355/10 X |
| 3,907,423 | 9/1975 | Hayashi et al. | 355/10 |

FOREIGN PATENTS OR APPLICATIONS

| | | | |
|---|---|---|---|
| 269,855 | 11/1964 | Australia | 355/10 |

*Primary Examiner*—R. L. Moses
*Attorney, Agent, or Firm*—Frank J. Jordan

[57] ABSTRACT

A roller is disposed parallel and adjacent to a photoconductive drum with a small gap inbetween. The roller is made of an electrically conductive material and covered with an insulating coating of hard anodized aluminum. The roller is fixed to a shaft which is driven to rotate the roller in the same direction as the drum to remove excess developing liquid from the drum through viscous friction. Electrically conductive bearings are mounted on the ends of the shaft which have an outer diameter greater than the diameter of the roller. The bearings rotatably contact the surface of the drum to maintain the gap. Either insulating plastic bushings or layers of alumite are disposed between the ends of the shaft and the bearings to insulate the shaft from the bearings and thereby from the drum.

8 Claims, 9 Drawing Figures

EXCESS DEVELOPING LIQUID REMOVING DEVICE FOR ELECTROPHOTOGRAPHY

The present invention relates to excess developing liquid removing devices, and more particularly involves a device for removing excess developing liquid from photoreceptors in electrophotographic copying apparatus.

In one type of electrophotographic copying apparatus known in the art, a drum-shaped photoreceptor is electrically charged and then exposed to an optical image of an original while the photoreceptor is rotated to form thereon an electrostatic latent image which is developed by a developing liquid into a photoreceptor, or toner image and printed on copy sheets by transfer printing after excess developing liquid is removed from the surface of the photoreceptor by an excess developing liquid removing device. By this process, duplicates of the original are produced upon fixing of the toner images transferred to the copy sheets.

Various types of excess developing liquid removing devices have hitherto been used. There is a squeeze roller type in which a roller is brought into pressing engagement with the surface of the photoreceptor for squeezing out excess developing liquid from the photoreceptor. An air knife type uses a stream of air blown onto the surface of the photoreceptor to remove excess developing liquid from its surface. In a corona discharge squeeze type, excess developing liquid on the surface of the photoreceptor is removed by means of corona discharge, whereas in a proximity squeeze type excess developing liquid on the surface of the photoreceptor is removed by a blade arranged in close proximity to the photoreceptor.

Some disadvantages are associated with these types of excess developing liquid removing devices. The squeeze roller type tends to damage the toner image on the photoreceptor because the roller is brought into pressing engagement with the surface of the photoreceptor. Difficulty is experienced in obtaining a roller having a smooth and planar peripheral surface, in maintaining good adherence of toner images on the photoreceptory and in synchronizing the rotation of the roller with the photoreceptor. In the air knife type, the air tends to become polluted by vaporization of the developing liquid and, the image on the photoreceptor tends to become splashed with the developing liquid. Also, noise is caused by the air stream, and the toner on the photoreceptor is blown by the air to cause distortion of the image. It is also difficult to apply a uniform air stream to the photoreceptor. In the corona discharge squeeze system, corona discharge produces ozone which tends to cause deterioration of the photoreceptor and the roller. Moreover, this type is low in efficiency when production of duplicates is carried out at high speed. The blade or the like is spaced apart from the photoreceptor in the proximity squeeze type, so that it is not possible to remove excess developing liquid sufficiently to produce dry duplicates by this system.

The present invention provides an excess developing liquid removing device wherein a roller, disposed in close proximity to the periphery of a photoreceptor, is rotated such that the surface of the roller disposed near the surface of the photoreceptor moves in a direction substantially opposite to the direction of movement of the surface of the photoreceptor so as to remove excess developing liquid from the surface of the photoreceptor and adjust the amount of developing liquid thereon to any level as desired in accordance with the peripheral velocity of the roller and the dimension of the gap between the roller and the photoreceptor, and the developing liquid collected on the roller is removed therefrom by a developing liquid removing means. The excess developing liquid removing device of the character described obviates the aforementioned disadvantages of the prior art and is highly efficient in removing excess developing liquid from the surface of the photoreceptor. The device permits dry duplicates to be obtained of a quality equal to or higher than that of the duplicates obtained by using the air knife type remover.

In addition, the roller used is electrically insulated and a bias voltage may be forcibly impressed on the roller to thereby minimize background staining in the duplicates produced. A conducting metal roller which is inexpensive to manufacture with close tolerances and highly rigid may advantageously be used. In this case, the roller is covered with a layer of anodized aluminum or resin to insulate it from the drum. Bearings carried at the ends of a shaft supporting the roller are insulated from the shaft by plastic insulating bushings or layers of alumite on the ends of the shaft.

FIG. 1 is a schematic side view of an electrophotographic copying apparatus in which the present invention is incorporated;

FIG. 2 (*a*) and FIG. 2 (*b*) are a sectional front view and a sectional side view, respectively, of the excess developing liquid removing device illustrating one embodiment of the invention;

Figure 1:
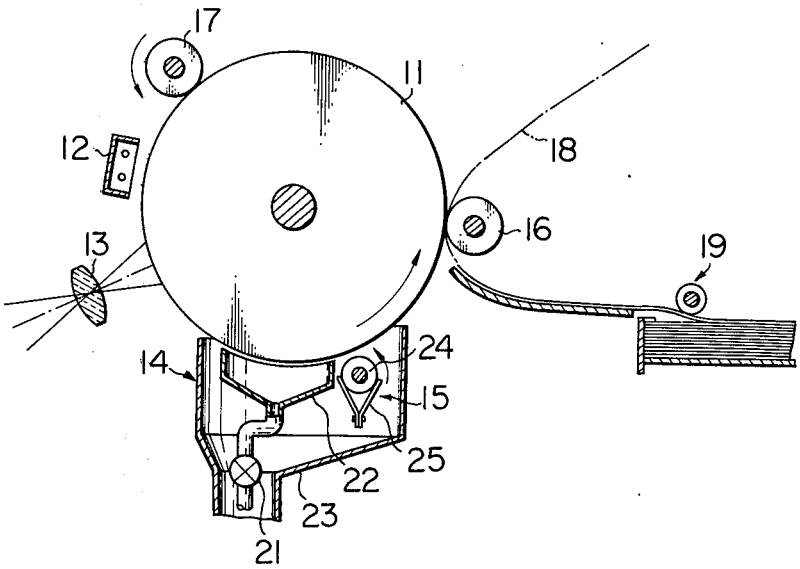

An electrically conductive drum-shaped photoreceptor 11 of the type used with the present invention is shown in FIG. 1, driven by drive means (not shown) to rotate at a predetermined rate, and with an electrical discharge device 12, an exposing device 13, a developing device 14, an excess developing liquid removing device 15, a transfer-printing device 16 and a cleaning device 17, all arranged about the photoreceptor 11. In operation, the photoreceptor 11 first has its entire photoconductive peripheral surface charged electrically by the device 12 and the charged peripheral surface of the photoreceptor 11 is then exposed to an optical image of an original by the exposing device 13 to form thereon an electrostatic latent image of the original. The electrostatic latent image is developed into a visible toner image with a developing liquid by the developing device 14 and excess developing liquid on the surface of the photoreceptor 11 is removed by the excess developing liquid removing device 15. The visible image is then printed on a copy sheet 18 by the transfer-printing device 16, and the photoreceptor 11 is cleaned by the cleaning device 17.

The transfer-printing device 16 may use a transfer-printing roller, or it may be an electrostatic transfer-printing device. A copy sheet 18 is fed between the photoreceptor 11 and the transfer-printing device 16 by a copy sheet feed device 19 at a rate which is in synchronism with the rotation of photoreceptor 11, and the copy sheet 18 is separated from the photoreceptor 11 by separating means (not shown) after the visible or toner image on the periphery of the photoreceptor 11 is printed on the copy sheet 18 by the transfer-printing device 16. The separated copy sheet 18 is ejected onto a suitable duplicate discharge tray (not shown).

The developing device 14 may comprise a pump 21 for delivering developing liquid to a supply means 22 from which the developing liquid is supplied to the photoreceptor 11. The developing liquid spilled by the supply means 22 is recovered by a vessel 23.

Figure 2:
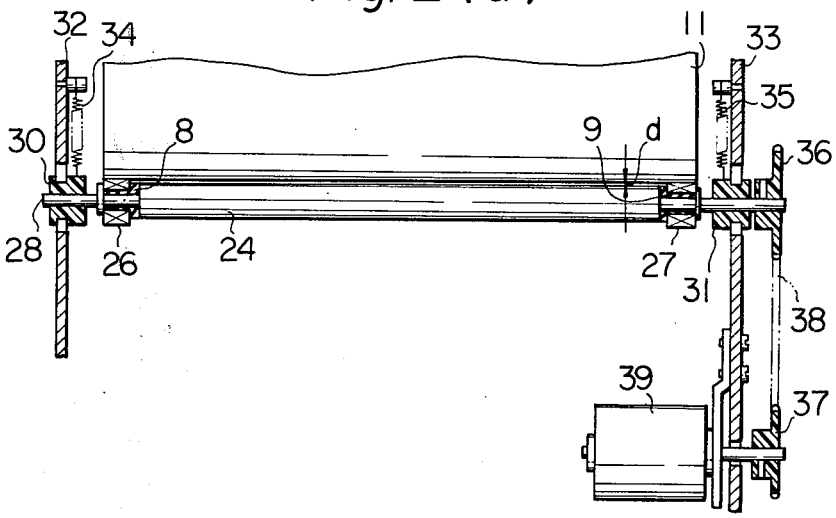
Figure 2:
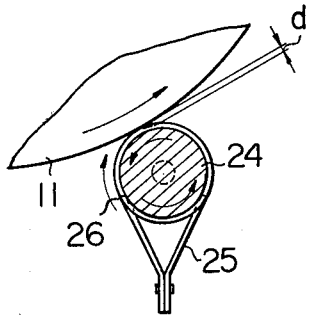

The excess developing liquid removing device 15 comprises an electrically conductive shaft 28 which supports an electrically conductive aluminum roller 24 for rotation therewith and a blade means 25 disposed in the excess developing liquid collecting vessel 23. As shown in FIG. 2 (*a*) and FIG. 2 (*b*), the shaft 28 supports at its ends which extend external of the roller 24 rolling contact bearings 26 and 27. Insulating means such as plastic bushings 8 and 9 are disposed between the ends of the shaft 28 and the bearings 26 and 27 to insulate the shaft 28 from the bearings 26 and 27. The bushings 8 and 9 may be replaced by other means such as layers of alumite formed on the ends of the shaft 28. The outer surfaces of the bearings 26 and 27 developing engage with the surface of the photoreceptor 11. Bearings 30 and 31 made of an electrically insulating material rotatably support the ends of the shaft 28 adjacent self-bias the bearings 26 and 27 respectively. It is to be noticed that the bushings 8 and 9 as the insulating means may be omitted if the shaft 28 is made of an electrically insulating material. electrical The bearings 30 and 31 are supported by support plates 32 and 33 respectively for movement toward and away from the axis of the photoreceptor 11. A spring 34 is mounted between the support plate 32 and bearing 30 and a spring 35 is mounted between the support plate 33 and bearing 30, so that the bearings 30 and 31 are urged by the biasing forces of springs 34 and 35 to move upwardly toward the photoreceptor 11.

The bearings 26 and 27 each have a radius which is greater than the radius of the roller 24 by a value in a range from 0.01 to 1 millimeter and are urged by the biasing forces of the springs 34 and 35 into pressing engagement with opposite end portions of the periphery of photoreceptor 11. Thus, the roller 24 is spaced apart from the periphery of photoreceptor 11 by a gap *d* in a range from 0.01 to 1 millimeter.

An electrically non-conductive sprocket wheel 36 is mounted on the shaft 28, and a chain 38 is trained over the sprocket wheel 36 and another sprocket 37 which is connected to a drive shaft of a variable speed motor 39. Thus, the roller 24 may be rotated at any peripheral velocity as desired in the same direction as the direction of rotation of the photoreceptor 11, that is, both counterclockwise as shown in FIG. 2 (*b*) by the variable speed motor 39 through the sprocket wheel 37, chain 38, and sprocket wheel 36. The bearings 26 and 27 engage with and are rotated by the photoreceptor 11 in the opposite direction which is clockwise in FIG. 2 (*b*). The movement of the surface of the roller 24 in a direction opposite to the adjacent surface of the photoreceptor 11 removes excess developing liquid from the photoreceptor 11 by viscous friction and adjusts the amount of developing liquid on the photoreceptor 11 in accordance with the rate of rotation of the roller 24 and the dimension of the gap *d* between the photoreceptor 11 and the roller 24. By varying the rotational speed of the motor 39, it is thus possible to control the amount of developing liquid on the periphery of photoreceptor 11. The blade 25 is maintained in pressing engagement with the roller 24 for removing developing liquid from the periphery of the roller 24 so that the roller 24 is cleaned and the removed developing liquid is collected in the vessel 23.

Figure 4:
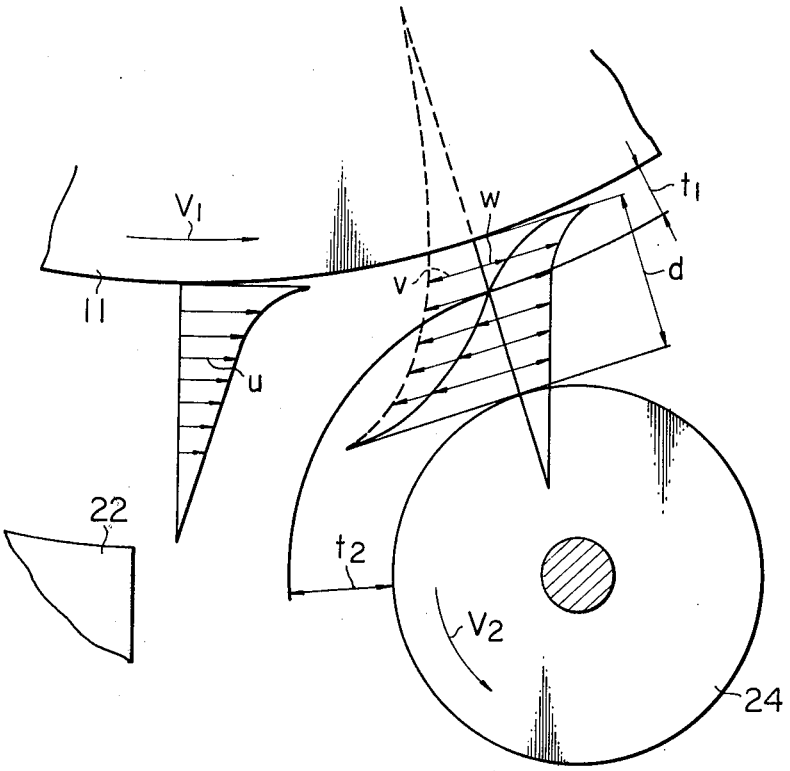
FIG. 4 is a view in explanation of the operation of the illustrated embodiment.

Operation of the roller 24 of the excess developing liquid removing device 15 will now be described. The developing liquid on the photoreceptor 11 after application to the electrostatic latent image thereon has a thickness of several hundred microns due to surface tension. By virtue of the rotation a flow of developing liquid of a speed U oriented in the direction of rotation of the photoreceptor 11 takes place on the peripheral surface of the photoreceptor 11 as shown in FIG. 4. Likewise, a flow of developing liquid of a speed V takes place on the roller 24 in its direction of rotation. Thus, a flow of developing liquid of a speed $U - V = W$ takes place between the photoreceptor 11 and roller 24, so that the developing liquid is separated into two streams.

If the rate of rotation V2 of the roller 24 is increased, the speed V will be increased and the thickness $t_2$ of the developing liquid removed from the photoreceptor 11 will be increased. The removal value of V2 becomes saturated when the rate of rotation of the roller 24 exceeds a certain level depending upon the coefficient of viscosity, surface tension and specific gravity of the developing liquid, the diameter and degree of surface smoothness of the photoreceptor 11 and roller 24, and other conditions. Experiments have been carried out using ISOPAR G (trade name) and ISOPAR H (trade name) as the developing liquids, and rotating the roller 24 in the same direction as the photoreceptor 11 and then stopping its rotation and rotating it in a direction opposite to the direction of rotation of the photoreceptor 11. It was ascertained that when the peripheral speed of the roller 24 exceeds 1,200 mm/sec, the value of $t_2$ is constant even if the dimension of the gap *d* is varied.

Figure 3:
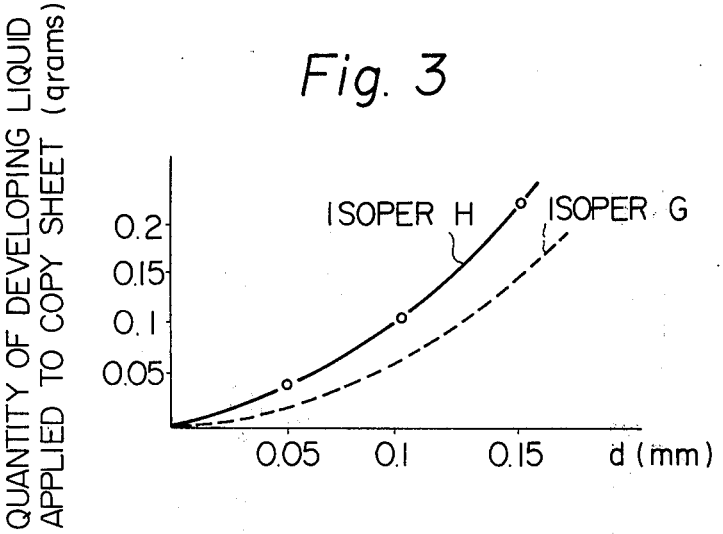
FIG. 3 is a diagram showing the characteristics of the illustrated embodiment.
Figure 5:
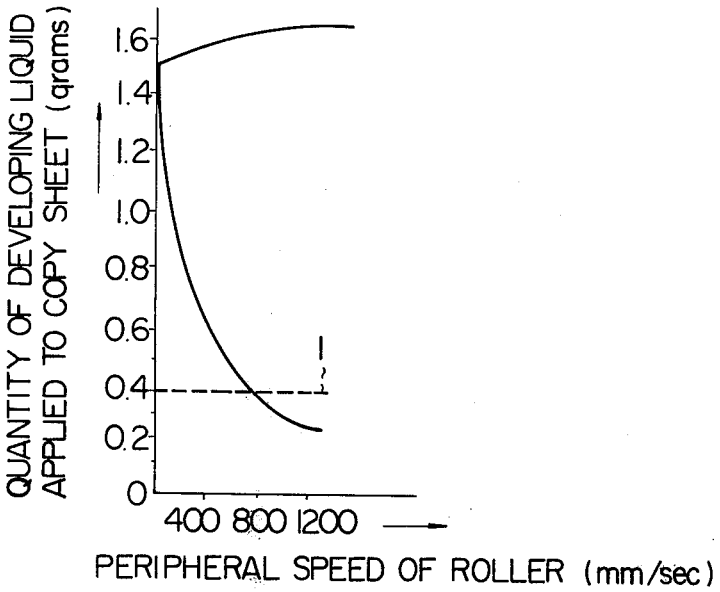
FIG. 5 is a diagram showing the characteristics of the illustrated embodiment.

When the peripheral speed of the roller 24 and the gap *d* were varied, the amount of developing liquid transferred from the photoreceptor 11 to the copy sheet 18 was as shown in FIGS. 3 and 5 with the sheet 18 being of A4 size (Japanese Industrial Standards ), $297 \times 210$ mm$^2$ and of high quality paper with the surface speed of the roller 24 being 600 mm/sec in FIG. 3. When the gap *d* was varied in dimension, the amount of transferred developing liquid varied in parabolic manner as shown in FIG. 3. The surface speed of the photoreceptor 11 was 220 mm/sec. In FIG. 5, the dotted line *l* is the limit below which the copy sheets 18 ejected onto the duplicate-receiving tray are not wet to the touch. That is, when the amount of developing liquid adhering to the copy sheets 18 is below the limit *l*, they are dry to the touch. It was found that when the roller 24 was rotated in the opposite direction to the photoreceptor 11 or the rotation of the roller 24 was stopped, the amount of developing liquid adhering to the photoreceptor 11 was increased by over eightfold above the level of the minimum amout of developing liquid adhering to the photoreceptor 11 when the roller 24 was rotated in the same direction as the direction of rotation of the photoreceptor 11. It was thus ascertained that by rotating the roller 24 at a peripheral speed of over 800 mm/sec in a direction opposite to the direction of rotation of the photoreceptor with the gap *d* being in a range from 0.05 to 0.1 millimeter, excess developing liquid was removed without damaging the toner image on the photoreceptor 11 and dried duplicates of high quality could be produced by using the roller 24 alone.

It is important that the thickness of developing liquid adhering to the photoreceptor 11 immediately after the electrostatic latent image has been developed be greater than the gap *d*. For example, when the developing liquid is small in amount and its thickness is reduced in part below the level of *d*, or when the roller 24 is disposed such that the liquid film is torn apart in part as the roller 24 increases its peripheral speed in rotating in a direction opposite to the direction of rotation of the photoreceptor 11, the thickness $t_2$ is reduced and the thickness $t_1$ of developing liquid remaining on the photoreceptor 11 is increased. As a result, the amount of developing liquid adhering to the photoreceptor 11 will be greater than is necessary. Thus, it was ascertained that the roller 24 should be disposed near the developing position and immediately below the photoreceptor 11. Also, it was ascertained that distortion of the developed image was less likely to occur if the roller 24 was disposed near the developing position, because the force of the photoreceptor 11 to attract the toner electrically was reduced in going from the developing device 14 in the direction of rotation of the photoreceptor 11. It was also ascertained that the smaller the diameter of the roller 24, the greater was the amount of developing liquid removed.

Figure 7:
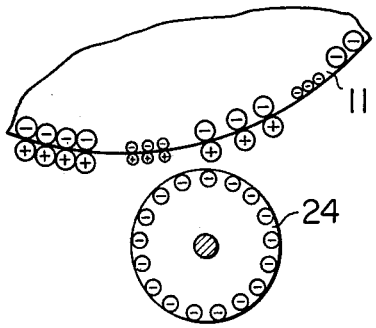
FIG. 7 is a view showing a modification to the device of the invention.

The roller 24 of the aforementioned excess developing liquid removing device 15 may be electrically insulated from other parts of the apparatus so that it may electrically float and have a self-bias effect. More specifically, image regions of the photoreceptor 11 shown in FIG. 7 have an electric potential ranging from −900 to −950 volts and non-image regions have an electric potential of about −150 volts. If an electric potential of about −300 volts is induced in the roller 24, the electric potential of the roller 24 will be lower than the image regions of the photoreceptor 11 and higher than the non-image regions thereof. As a result, toner will flow to the image regions and the toner on the non-image regions will be attracted to the image regions. Thus, duplicates of high quality with a clear-cut image of high contract having no background staining can be produced. The roller 24 may be made of an electrically conducting material. However, a coat of rubber having a volume resistivity of over $10^8$ Ωcm can be applied to the roller 24, and any other material may be used for the roller 24 so long as it has a self-bias effect.

Since the roller 24 operates in the presence of a large amount of developing liquid immediately after the electrostatic latent image on the photoreceptor 11 is developed, the developing step may be considered to be prolonged. In the case where the roller 24 is electrically conducting, all the toner will be transferred to the photoreceptor 11 by electrophoresis if the roller 24 is used while being grounded but without being insulated from other parts. In such event, the toner will adhere to non-image regions of the photoreceptor 11 having an electric potential of −200 volts, thereby causing background staining in the duplicates produced. Therefore, the roller 24 should be insulated from other parts.

It has been found in practice that the thickness of the toner image constituted by toner particles in the developing liquid immediately after the developing step is about 10 microns, and that the lower limit of the gap *d* by which the toner image will not be affected by the roller 24 is about 20 microns. With such a small gap *d*, the copy sheets 18 come out of the device substantially dry to the touch, and a drying apparatus is not required. Although it is difficult in practice to maintain a gap *d* as small as 20 microns, a gap of about 0.1 mm will provide good transfer efficiency of toner particles and the copy sheets 18 will be sufficiently dry that a drying apparatus is not required.

Figure 8:
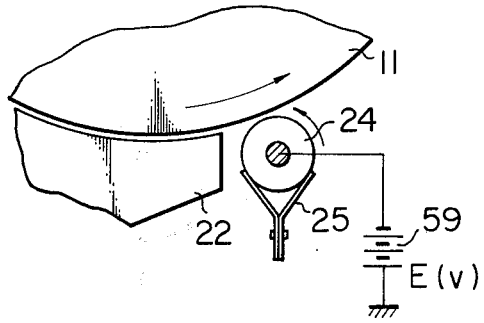
FIG. 8 is another view showing an additional modification.

A bias voltage E(V) may be forcibly impressed from a DC power source 59 to the roller 24 of the excess devolping liquid removing device 15 as shown in FIG. 8 so that the roller 24 may have a bias effect. This system is more effective than the aforementioned self-biasing system in producing duplicates of uniform contrast in all cases, because the results achieved by the self-bias system tend to show variations depending on the size of the original. The impressed bias voltage is set such that it is lower than the electrical potential of the image regions of the photoreceptor 11 and higher than the electrial potential of the non-image or background regions. The impressed bias system can achieve better results than the self-bias system in reducing background staining of the duplicates produced and achieving higher contrast of the image. The roller 24 may be made of an electrically conducting material, but it may be made of an insulating material and a bias potential may be imparted to it through corona discharge by means of an electrical discharge device, or through frictional charge by means of a blade such as the blade 25 which is maintained in pressing engagement with the surface of the roller 24. The insulating material may be a hard resin, glass or ceramics.

When the roller 24 is charged to provide a biasing effect either by self or induced bias, it is essential that the dielectric breakdown strength of the insulating layer on the surface of the drum 24 be more than 250 volts and the insulating resistance of the layer be more than $10^6$ ohms to ensure clean background areas in the copy sheet 18. If the roller 24 is made of aluminum, the insulating layer can be hard andozided aluminum which will add to the mechanical wear resistance of the surface of the roller 24.

Figure 6:
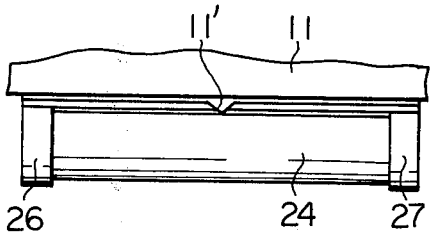
FIG. 6 is a view in explanation of the background staining in the duplicates produced.

Referring now to FIG. 6, it is found in practice that the surface of the photoreceptor 11 is not perfectly flat but is formed with tiny protrusions such as at 11'. When the gap *d* is very small, the roller 24 will engage at the protrusion 11' with the photoreceptor 11 and scrape the photoconductive layer off the top of the protrusion 11' to expose the conductive portion of the photoreceptor 11 below. This conducting portion will be then engaged with the roller 24 during subsequent revolutions of the photoreceptor 11 and roller 24. This would have the effect, if the insulating layer were not provided on the surface of the roller 24, of grounding the roller 24 to destroy the biasing effect and cause smearing of the background of the copy sheet 18. This effect is noticeable for a width of about 2–3mm along the entire length of the photoreceptor 11 in the region of the protrusion 11'. However, with the provision of the insulating layer on the roller 24, this effect is reduced to neglibible proportions since the roller 24 is not grounded. If the potential in the background areas of the photoreceptor 11 is less than 20 volts, the bushings 8 and 9 may be replaced by a layer of alumite on the outer surfaces of the ends of the shaft 28. It will be clearly understood that either the bushings 8 and 9 or the alumite layer prevent the roller 24 from being grounded through the shaft 28 and bearings 26 and 27 and small holes formed in the photoconductive layer of the photoreceptor 11 by abrasion. The bushings 8 and 9 also serve to concentrically mount the bearings 26 and 27 on the shaft 28.

It will be understood that the shaft 28 may be integrally fixed for rotation with the roller 24.

It will further be understood that the photoreceptor does not have to be in the form of a drum, but may be a belt or moving plate. Alternatively, the photoreceptor may be a sheet of photoconductive copy paper.

Other modifications to the present invention within the scope thereof will become possible to those skilled in the art after receiving the teachings of the present disclosure.

What is claimed is:

1. In an electrophotographic device having a moving photoconductive member and means for applying liquid developer to the surface of the photoconductive member, the combination therewith of:

an electrically conductive shaft disposed downstream of said means, the axis of the shaft being perpendicular to the direction of movement of the photoconductive member;

an electrically conductive roller integrally fixed for rotation with the shaft, the shaft extending external of the ends of the roller;

two rolling contact bearings supported by the respective ends of the shaft, the outer diameters of the bearings being greater than the diameter of the roller, the outer surfaces of the bearings rollingly engaging with the surface of the photoconductive member;

drive means to rotate the shaft so that the surface of the roller moves in a direction opposite to the surface of the photoconductive member, the drive means being electrically insulated from the shaft;

first electrical insulating means covering the surface of the roller; and second electrical insulating means disposed between the ends of the shaft and the respective bearings.

2. The device according to claim 1, in which the first electrical insulating means is a layer of hard anodized aluminum having a dielectric breakdown strength greater than 250 volts and an insulation resistance greater than $10^6$ ohms.

3. The device according to claim 1, in which the first electrical insulating means is a layer of hard resin having a dielectric breakdown strength greater than 250 volts and an insulation resistance greater than $10^6$ ohms.

4. The device according to claim 1, in which the second electrical insulating means comprises two bushings made of an electrical insulating material disposed between the ends of the shaft and the respective bearings.

5. The device according to claim 4, in which the electrical insulating material comprises plastics.

6. The device according to claim 1, in which the second electrical insulating means comprises a layer of alumite.

7. The device according to claim 1, further comprising biasing means for applying a bias potential to the roller.

8. The device according to claim 7, in which the biasing means comprises a direct current electric power source.

* * * * *